United States Patent [19]

Huang

[11] 4,288,947

[45] Sep. 15, 1981

[54] MODULAR INFLATABLE DOME STRUCTURE

[76] Inventor: Yen T. Huang, 9405 Pinewood Dr., Dallas, Tex. 75231

[21] Appl. No.: 937,483

[22] Filed: Aug. 28, 1978

[51] Int. Cl.[3] ..... E04B 1/32

[52] U.S. Cl. ..... 52/2; 52/81; 52/309.5; 403/170; 403/217

[58] Field of Search ..... 52/2, 81, 309.5; 403/217, 170

[56] References Cited

U.S. PATENT DOCUMENTS

| | | | |
|---|---|---|---|
| 1,964,818 | 7/1934 | Hood | 52/2 |
| 2,591,829 | 4/1952 | Katzenmeyer | 52/2 |
| 2,812,769 | 11/1957 | Schaffer | 52/2 |
| 2,918,992 | 12/1959 | Gelsavage | 52/81 |
| 3,341,989 | 9/1967 | Emmerich | 52/81 |
| 3,830,011 | 8/1974 | Ochrymowich | 52/81 |
| 3,898,777 | 8/1975 | Georgiev | 52/81 |

FOREIGN PATENT DOCUMENTS

| | | | |
|---|---|---|---|
| 981867 | 1/1976 | Canada | 52/81 |

*Primary Examiner*—John E. Murtagh

*Attorney, Agent, or Firm*—Thomas L. Cantrell; Joseph H. Schley; Stanley R. Moore

[57] ABSTRACT

A modular dome structure constructed by using uniform Y joints which have branches forming angles of 120°, 120° and 108°. The Y joints are interconnected by uniform length members to form pentagonal and hexagonal structures. These modular structures are interconnected to form a modular dome structure which may have a pentagonal apex structure or a hexagonal apex structure.

All members are made to harden after inflation due to vulcanization and curing process, so that permanent resistance to stress and strain will be provided in its final form. Due to inflatability of members, the logistic involved in actual construction will be kept minimum, and the freight cost for material transportation will be saved significantly.

6 Claims, 15 Drawing Figures

MODULAR INFLATABLE DOME STRUCTURE

BACKGROUND OF THE INVENTION

1. Field of the Invention

This invention relates to modular cell structures which can be air supported and reinforced and subsequently stabilized to form a rigid structure or may be originally constructed as a rigid structure.

2. Description of the Prior Art

Dome structures are known in the prior art and are commonly seen in use for athletic arenas, auditoriums and other facilities. Quite often these domes are air inflated. These structures are typically very complex and require a precise design before construction. During construction, the process is very exact and must be performed by a skilled person with an ability to read the detailed instructions. Further, because of the specific design requirements of each individual structure, the costs are relatively high. The present invention overcomes these difficulties by providing a structure easily constructed and relatively inexpensive due to the uniformity of its component parts.

Various proposals have been made in the past for the construction of domed inflatable structures.

Further, the normally existing inflatable system requires a constant supply of air pressure internally within the dome by utilizing large mechanical blowers and other mechanical devices to sustain this structural configuration during usage. It is an object of the invention to overcome this requirement. The normal existing systems also use cable suspension systems to maintain their dome shape. It is an object of this invention to provide a dome structure which does not require a series of cable suspensions to maintain its dome shape.

SUMMARY OF THE INVENTION

The modular dome structure comprises a plurality of uniform Y joints and uniform length members. The Y joints preferably have branches forming angles of 120°, 120° and 108°, and are uniform in the sense that all Y joints in a given structure are identical in configuration (and preferably in dimensions also), although they may differ in space orientation. The Y joints are inter-connected using the uniform length members. Each branch of the Y joint is provided with a means for attaching the members to the Y joints which may consist of a female groove in each branch and a mating male device with a notch or a single ring fitted to mate with the groove. The member material is attached to the Y joint branch by fitting it between the female groove on the branch and the mating device with seals on the grooves.

In accordance with another aspect of the invention, the members of the modular dome structure may be constructed so that they are inflatable. The Y joint branches are provided with valves to control flow rate into each member. After inflation, the inflatable members may be stabilized by vulcanization, hardening through the use of an internal osmostic catalytic reagent, injection or coating.

In accordance with another aspect of the present invention, the modular dome structure is enclosed, using modular panels for covering three panels of the structure. The modular panels consists of two hexagonal and one pentagonal structural covering.

During the construction of conventional dome structures, a vast amount of scaffolding and form work is normally required. Due to modular and inflatable constructions of the present invention, scaffolding becomes secondary in importance, and should result in substantial cost saving in construction.

DESCRIPTION OF THE DRAWINGS

For a more complete understanding of the present invention and for further advantages and objects thereof, reference is now made to the following description taken in conjunction with the accompanying drawings, in which.

DESCRIPTION OF THE PREFERRED EMBODIMENT

Figure 1:
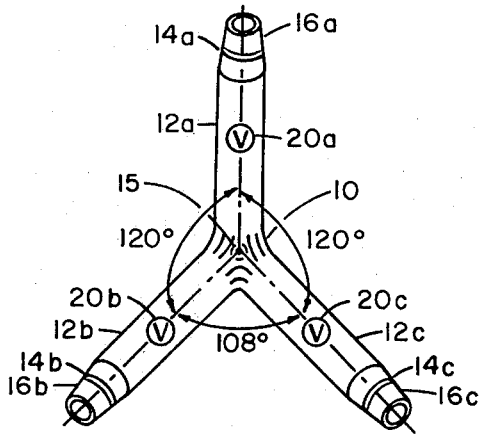
FIG. 1 is a perspective view of a Y joint incorporating the present invention.
Figure 2:
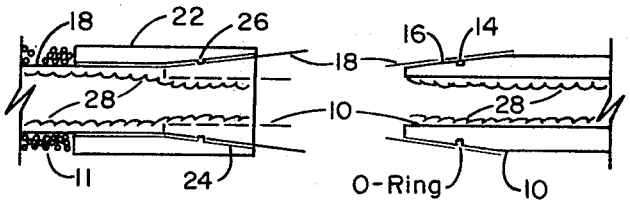
FIG. 2 is a detail of a device for attaching the members to the Y joints.

Referring now to FIG. 1, a Y joint 10 is shown with branches 12*a*, 12*b* and 12*c* making space angles of 120°, 108° and 120°; thus the Y joints are not planar, but are three-dimensional. Each branch of the Y joint 10 is provided with a female groove 14*a*, 14*b* and 14*c*. Each end of the branches 12*a*, 12*b* and 12*c* are provided with tapered ends 16*a*, 16*b* and 16*c*. In the preferred embodiment, members 18 (FIG. 3) are used which are inflatable by air or gas injection. Each member is of equal length and for purposes of ease of construction and mass production, will be equal in size, thickness and other characteristics, except at special corners and locations where special considerations are required. Control valves 20*a*, 20*b* and 20*c* are incorporated into each branch 12*a*, 12*b* and 12*c* of the Y joint 10 to regulate flow during construction.

Where the members consist of some type of membrane material such as rubber, a sealing device 22 such as that shown in FIG. 2 can be used to attach the member to the Y joint 10. The sealing device 22 is tapered out at its end 24 to engage with the tapered ends 16*a*, 16*b* and 16*c*. The interior of the sealing device 22 has a male notch 26 which mateably engages with the female grooves 14*a*, 14*b* and 14*c*.

Figure 3:
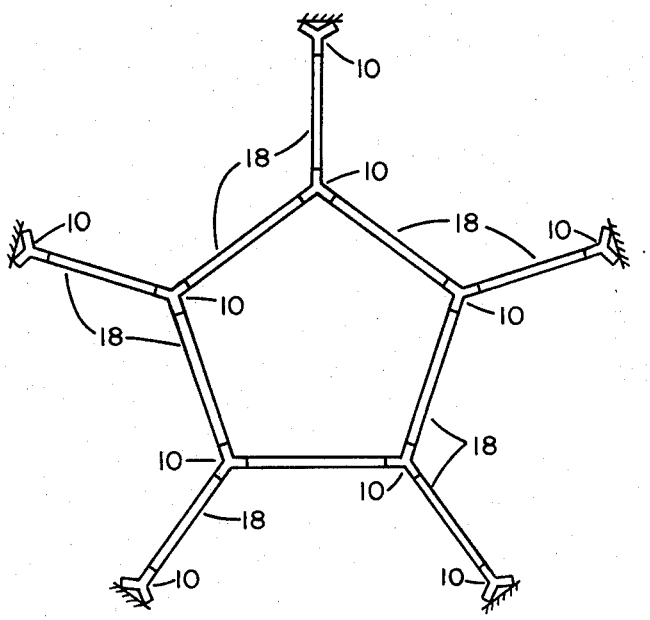
FIG. 3 is a view of a basic structure for a modular dome construction using a pentagonal apex.

Referring now to FIG. 3, a basic pentagonal apex structure can be constructed consisting of 10 members and 10 Y joints. Each member 18 interconnects Y joints 10. To construct the pentagonal apex, the space angle of 108° is used as an interior angle.

Figure 4:
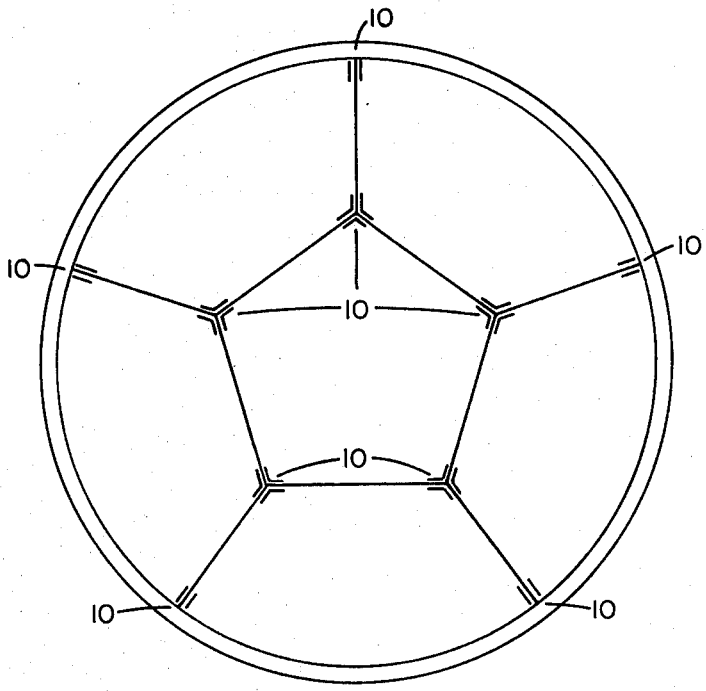
FIG. 4 is a view of a basic pentagonal structure with an accompanying circular foundation.
Figure 5:
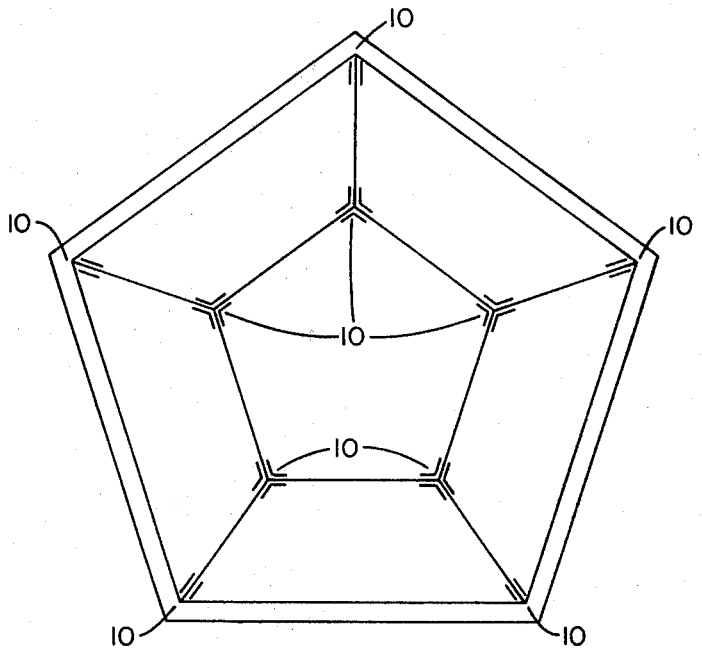
FIG. 5 is a view of a basic pentagonal structure with a pentagonal foundation.

The base of the pentagonal apex structure can be supported by a ring connecting the bottom five joints as shown in FIG. 4. This foundation could also be a pentagonal grade beam system as shown in FIG. 5 or a mat or spread footings. This basic structure will have a ceiling height of approximately one-half the length of each member and will form a partial dome. The number of members and joints may be increased in order to increase the height of the dome.

Figure 6:
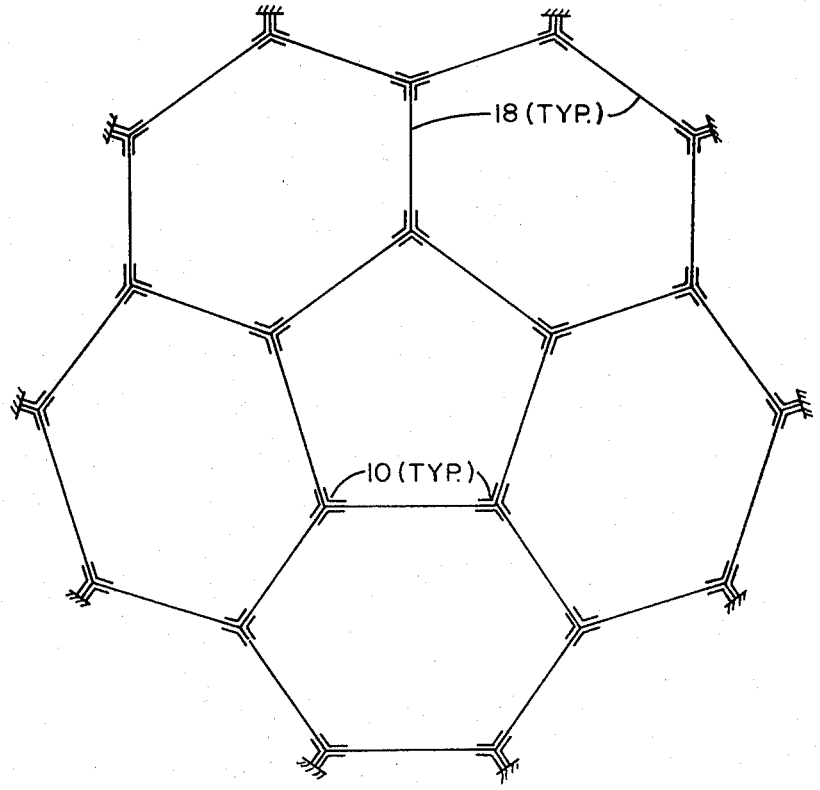
FIG. 6 shows a six panel pentagonal apex structure using the features of the present invention.

The basic pentagonal structure may be expanded by the addition of members and joints. Where a pentagonal apex is used, an initial secondary row of hexagonal structures will be constructed as shown in FIG. 6. The structure of FIG. 6 consists of six panels made by the modular construction of 25 members and 20 joints. This system raises the height of the ceiling to 1.26 times the length of each member.

Figure 7:
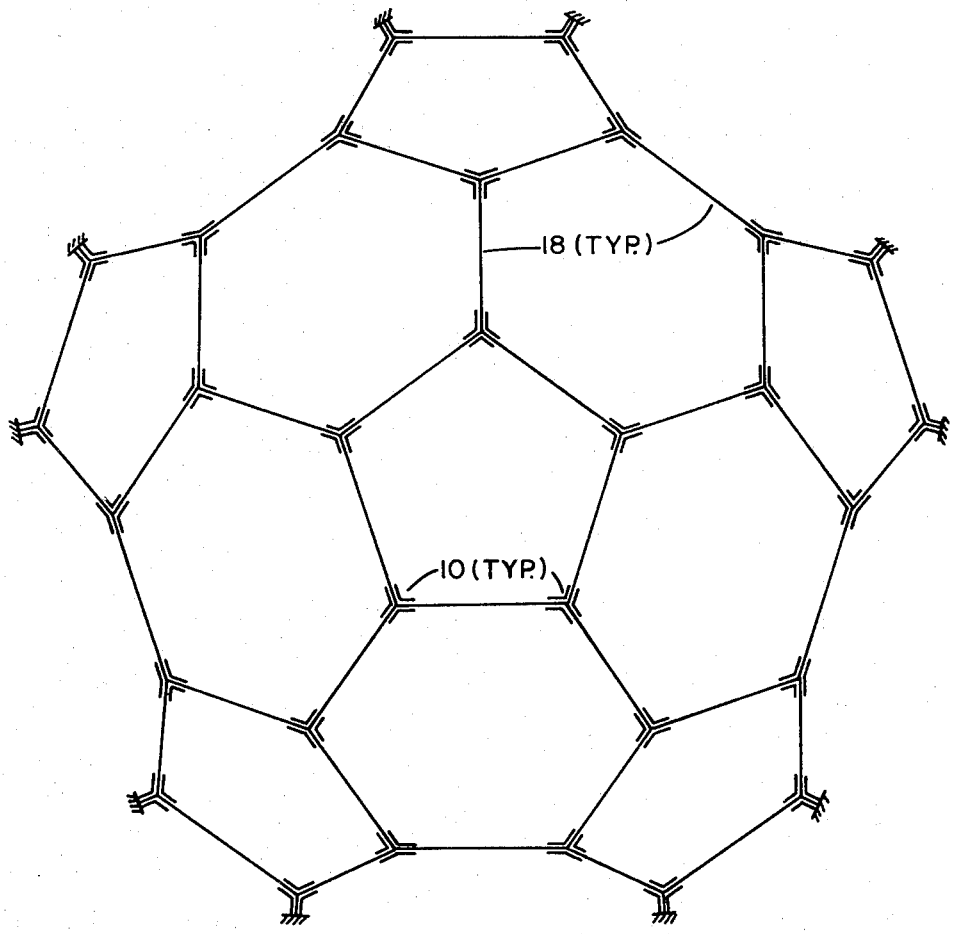
FIG. 7 shows an eleven panel structure using a basic pentagonal apex structure.
Figure 8:
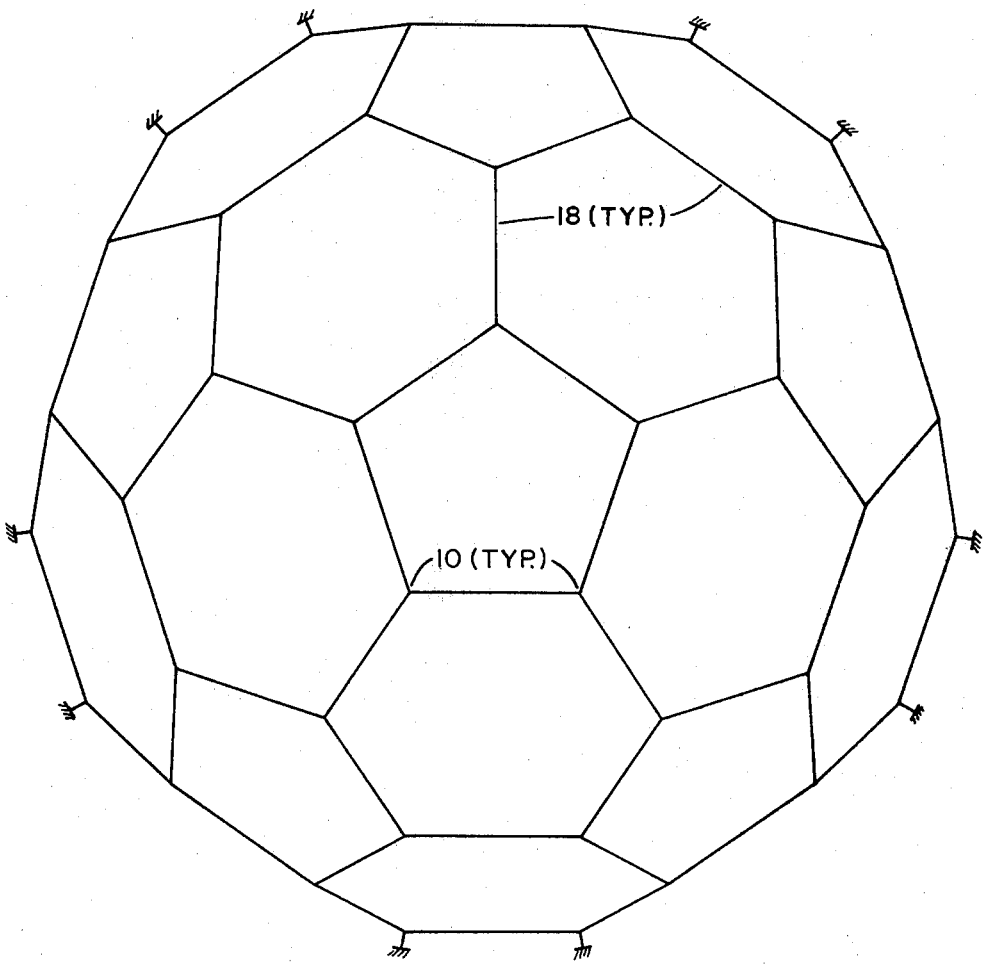
FIG. 8 shows a sixteen panel pentagonal apex structure using the features of the present invention.

An eleven panel pentagonal apex structure as shown in FIG. 7 can be constructed by the further addition of 15 members and 10 joints. This correspondingly raises the ceiling height to 2.03 times the length of each member. Referring to FIG. 8, the further addition of joints and members to a total of 55 members and 40 joints creates a sixteen panel semispherical dome.

Figure 9:
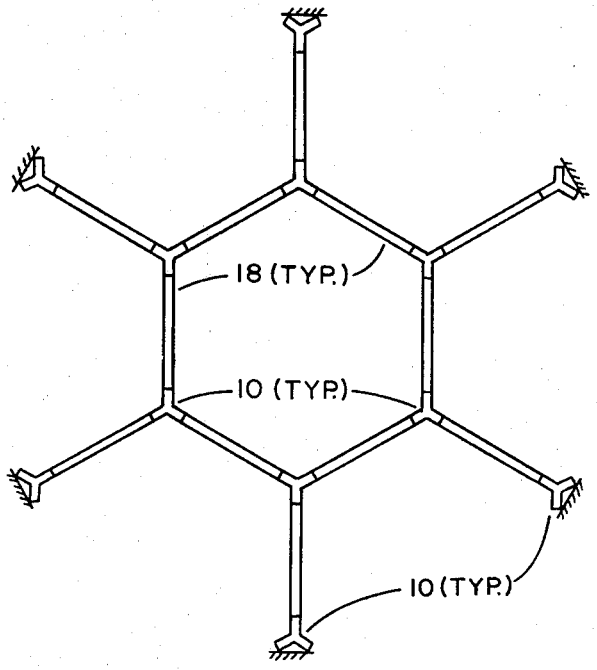
FIG. 9 is a view of a basic structure for a modular dome construction using a hexagonal apex.
Figure 10:
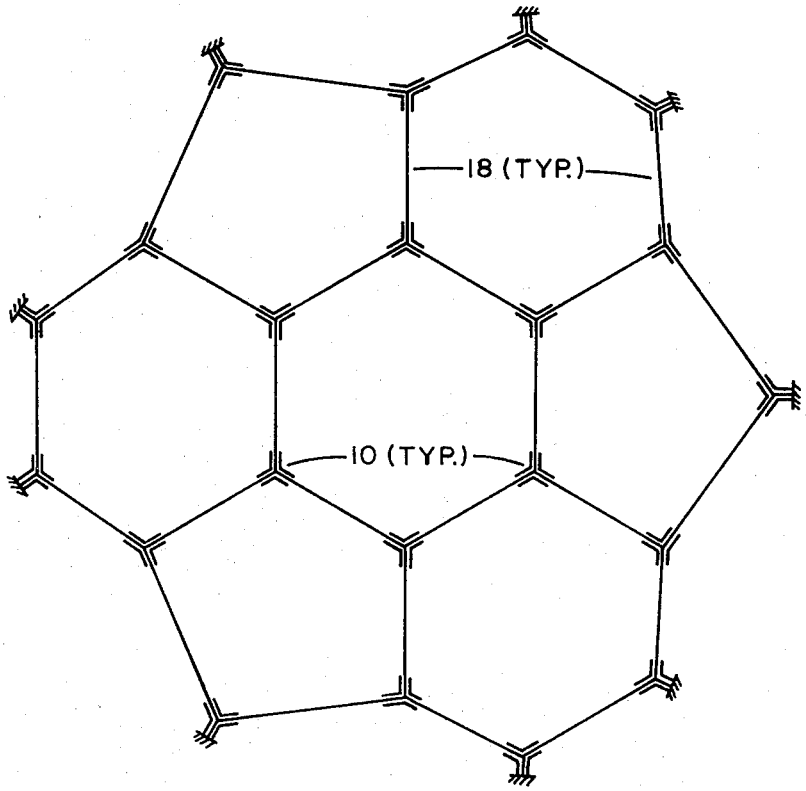
FIG. 10 shows a seven panel hexagonal apex structure using the features of the present invention.
Figure 11:
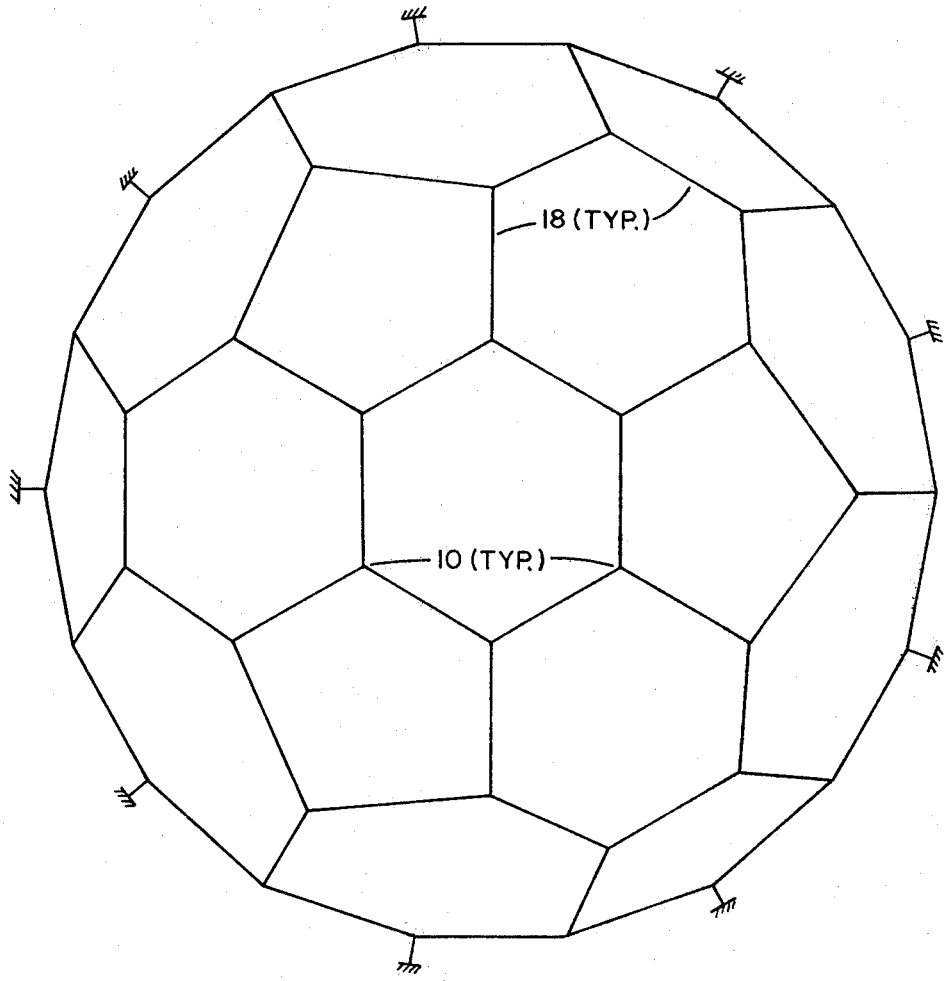
FIG. 11 shows a sixteen panel hexagonal apex structure using features of the present invention.

Referring now to FIG. 9, a basic hexagonal apex structure is shown. This basic structure consists of 12 members and 12 joints. Each member 18 interconnects Y joints 10 to form interior angles of 120°. This basic unit has a ceiling height of approximately 0.6 times the member length. A secondary row is composed of alternate hexagonal and pentagonal structures as shown in FIG. 10. This seven panel structure is constructed from 27 members and 21 joints. To achieve the semispherical dome as discussed above for the hexagonal apex structure, 54 members and 39 joints are necessary to form the sixteen panel sphere. Of these sixteen panels, ten will be hexagonal and six pentagonal as shown in FIG. 11.

In the preferred embodiment, a member is an inflatable balloon with an original length of 4 to 5 feet. If a rubber material is used for the member material, the member is capable of stretching to as much as 3 to 7 times its original length or approximately 20 feet. Therefore, 20 foot members result, and an area of approximately 7200 square feet can be covered using the modular dome construction of this invention. As the member length is increased, proportionately larger areas are covered. For very large member sizes, truss members can be used to achieve structural safety.

Unlike the conventional triangular combinations which rely on pin connected triangular formations for their stability, the present invention finds its stability in the rigid Y joints, in addition to any rigidity of each member. Once the inflatable structure is constructed, the members may be stabilized by various means. One method of stabilization is by injection of filler material 28 shown in FIG. 2, e.g. air-entrained foam rubber, polystyrene, EPDM, polyurethane latex foam or reactive gas, such as sulphic gas which vulcanizes the rubber membrane and stabilizes the member membrane walls. Further, for moment-resisting composite members, the coating 11 (FIG. 2) utilized outside the inflatable member or the filler 28 used inside the inflatable member can be such a material that it hardens after reaction with the injected gas. If membranes are sufficiently porous, impervious outside coating 11, e.g. Portland Cement or sprayable polyurethane can be used. Butyl rubber and isobutene-isoprene rubber (IIR) are known to have low permeability characteristics to gases and perform favorably to sunlight. Such material can be used without additional treatment where there is no danger of deflation due to accidental puncture or damage to the modular members 18.

Therefore, three methods of stabilization are acceptable with the preferred embodiment. First, after vulcanizing the rubber member material, proper and adequate curing and hardening of the member material sufficient to withstand an exterior load will make it unnecessary to have additional means of protecting each member 18. A second technique involves the injection of air-entrained lightweight material 28 which gains strength as it hardens. Material injected could be either sufficient to fill the full void to form a solid member or partially fill the void in order to form a hollow member. Finally, a third method involves the use of a protective coating 11 on the outside of the member membrane. Many materials could be used such as synthetic rubber material and also non-synthetic inorganic cementing material such as cement, grout, mortar or concrete. Further, combinations of the above three methods may be desirable when different processes act catalytically to strengthen the member membrane without significant increase in cost.

Figure 12:
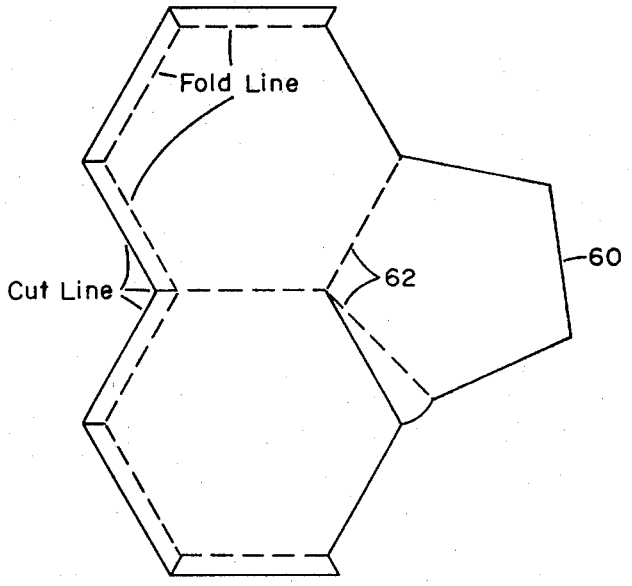
FIG. 12 shows a modular panel for use with the present invention.

As shown in FIG. 12, a modular panel system is also used to construct the shell for the modular dome structure. The modular panel 60 consists of two hexagonal panels and one adjoining pentagonal panel. As shown in FIG. 12, the modular panel can be constructed from a flat piece of material by making a cut or fold at 62 to obtain the proper angles of 120°, 120° and 108°. The fold removes an angle of 12°. Different arrangements in the modular panels can be used to obtain coverage of the modular shell structure including the use of a skylight. Looking at FIG. 7, the use of five modular panels would provide overlapped layer coverage of the hexagonal panels leaving the remaining pentagonal apex structure as the skylight. In FIG. 6, coverage may be obtained with any number of modular panels and a multiple pentagonal apex structure. If as many as five modular panels are used to obtain a two-ply secondary row, the pentagonal apex structure results in a five-ply covering. Particularly suitable panel materials are the teflon coated canvas developed by Owens-Corning Fiberglass Corporation and E. I. du Pont De Nemours & Company. This shell structural covering further acts to provide additional structural strength.

The shell panel system is a self-supporting structure in its entirety. The overlapping feature of the panel system makes it especially suited for reinforcement where needed. Additionally, the panel system can be reinforced either from inside or suspended in its entirety from connecting joints from the outside.

Figure 13:
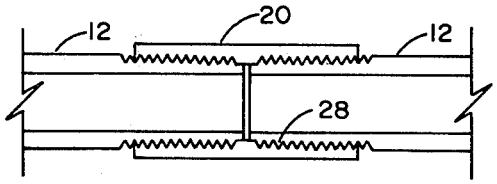
FIG. 13 shows a screwing type end coupling.
Figure 14:
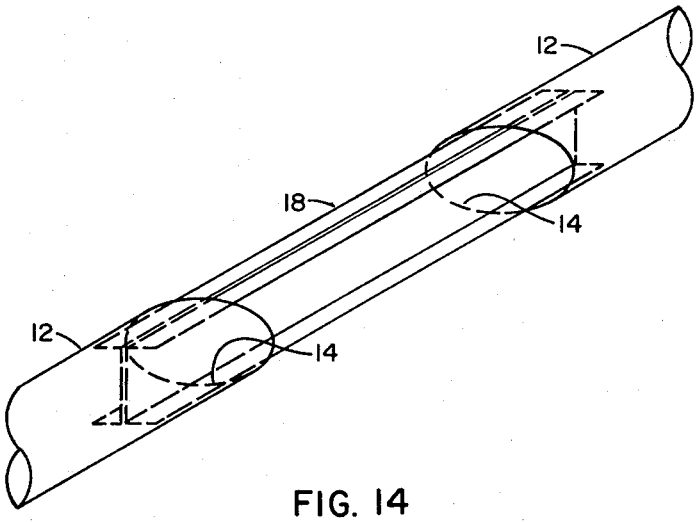
FIG. 14 shows members other than tubular type.
Figure 15:
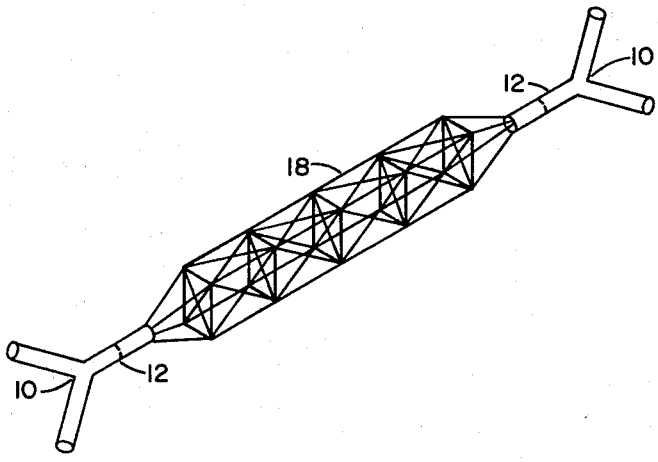
FIG. 15 shows a truss member which is a framed structure.

Referring now to FIGS. 13, 14 and 15, where members 18 are rigid and consist of non-inflatable material, the special considerations required in inflatable members become unnecessary. Under those circumstances, ordinary screw-in type end coupling, shown by FIG. 13 can be engaged. Alternately, angular or built-up members may be used as shown in FIG. 14. For large span distance between joints 10, it becomes necessary to use trussed members as shown in FIG. 15.

Although the preferred embodiment of the invention has been illustrated in the accompanying drawings and described in the foregoing detailed description, it will be understood that the invention is not limited to the embodiments disclosed, but is capable of numerous rearrangements, modifications and substitution of parts and elements without departing from the spirit of the invention.

What is claimed is:

1. A joining device comprising connecting branches extending from a central axis to form a rigid Y shape forming acute angles from the plane perpendicular to a vertical axis through the vertex of the Y, the branches forming angles of 120°, 120°, and 108°, with one another, and further comprising a female groove on each branch and a sealing ring to fit into the female groove over any material sought to be connected to the branch.

2. The joining device of claim 1 further comprising tubular walls shaped to enclose a hollow interior and valves to control the flow of material through the enclosed interior.

3. A joining device comprising connecting branches extending from a central axis to form a rigid Y shape, forming acute angles from the plane perpendicular to a vertical axis through the vertex of the Y, the branches forming angles of 120°, 120°, and 108°, with one another, and further comprising a female groove on each branch and a male notched member to engage said female groove and fasten any material sought to be connected to the branch.

4. A modular dome structure comprising:

a plurality of uniform rigid Y-joints, each having only three tubular arms, the arms defining space angles of 120°, 120°, and 108° with respect to each other, said tubular arms each having valve means thereon for controllably admitting flowable material thereinto;

a plurality of uniform length inflatable open ended tubular members connectable to said Y-joints to thereby form said dome structure;

means for attaching the ends of said members to said Y-joints, comprising female grooves on the tubular arms and internal male rib means on said members for mating gas tight engagement with said grooves;

each of said members being inflated to desired length by admission of gas through a valve in an attached adjacent Y-joint;

each of said members being stabilized in inflated condition by injection of gas entrained foam material through said open end of said member and through a valve in an attached adjacent Y-joint; and a plurality of modular panels covering said members and Y joints, at least some of said panels comprising two hexagonal sections and one pentagonal section integrally connected together.

5. A frame for a space structure comprising:

a plurality of uniform Y-joints, each of said Y-joints being rigid and having only three arms, the arms defining space angles of 120°, 120°, and 108° with respect to one another;

said Y-joint arms being tubular and having valve means therein for admission of gas therethrough;

inflatable members connected in gas-tight relation to the arms of said tubular members, said members each being individually inflatable through the valve means in either of the Y-joint arms to which it is connected.

6. The frame of claim 5 wherein the inflatable members are stabilized by the injection of an air-entrained foam material through said rigid tubular joints.

* * * * *